US011452178B2

(12) United States Patent
Miller et al.

(10) Patent No.: US 11,452,178 B2
(45) Date of Patent: Sep. 20, 2022

(54) HIGHLY FORMABLE SMART SUSCEPTOR BLANKETS

(71) Applicant: The Boeing Company, Chicago, IL (US)

(72) Inventors: Robert J. Miller, Fall City, WA (US); John F. Spalding, Jr., Renton, WA (US); Diane C. Rawlings, Bellevue, WA (US); Darrell M. Storvick, Tukwila, WA (US); Christopher J. Hottes, Seattle, WA (US)

(73) Assignee: The Boeing Company, Chicago, IL (US)

( * ) Notice: Subject to any disclaimer, the term of this patent is extended or adjusted under 35 U.S.C. 154(b) by 464 days.

(21) Appl. No.: 14/937,511

(22) Filed: Nov. 10, 2015

(65) Prior Publication Data

US 2017/0135157 A1 May 11, 2017

(51) Int. Cl.

| | |
|---|---|
| ***H05B 3/36*** | (2006.01) |
| ***H05B 1/02*** | (2006.01) |
| ***H05B 6/10*** | (2006.01) |

(52) U.S. Cl.

CPC ..... *H05B 3/36* (2013.01); *H05B 1/0272* (2013.01); *H05B 6/105* (2013.01); *H05B 2206/023* (2013.01)

(58) Field of Classification Search

CPC ..... H05B 2206/023; H05B 1/0272; H05B 2203/003; H05B 6/105; H05B 6/40; H05B 1/0202; H05B 3/36; H05B 2203/011; H05B 2203/013; H05B 2203/016; H05B 2203/029; H05B 2203/037; H05B 3/02; H05B 3/34; H05B 6/02; H05B 6/06; H05B 6/10; H05B 6/64; H05B 6/106; H05B 6/6491; H05B 6/04; H05B 6/362; H05B 6/36; H05B 3/54; H05B 3/146;

(Continued)

(56) References Cited

U.S. PATENT DOCUMENTS 5,248,864 A * 9/1993 Kodokian ..... B29C 35/08 156/272.2
7,323,666 B2 * 1/2008 Spohn ..... B32B 27/20 219/620

(Continued)

FOREIGN PATENT DOCUMENTS

EP 2575410 A2 4/2013
WO 03063548 A2 7/2003

OTHER PUBLICATIONS

Kestner, et al.; Susceptor Wire Array; U.S. Appl. No. 14/640,227, filed Mar. 6, 2015.

(Continued)

*Primary Examiner* — Tu B Hoang
*Assistant Examiner* — Diallo I Duniver
(74) *Attorney, Agent, or Firm* — Walters & Wasylyna LLC

(57) ABSTRACT

A heating blanket is disclosed. The heating blanket may include a thermoplastic matrix configured to become conformable at a predetermined temperature, a conductor embedded in the thermoplastic matrix and configured to receive electrical current and generate a magnetic field in response to the electrical current, and a plurality of susceptors embedded in the thermoplastic matrix and composed of a magnetic material having a Curie point.

20 Claims, 16 Drawing Sheets

(58) Field of Classification Search
CPC ..... H05B 2203/017; H05B 3/04; H05B 3/06; H05B 6/00; H05B 6/80; Y10T 29/49155; D10B 2401/16; D04B 1/12; H05K 1/00; H01L 33/641; H01B 19/04; H01B 5/00; G01R 27/02; B60N 2/002; B60N 2/5685; B29C 35/08; B29C 73/30; B29C 73/10; B29C 2035/0811; B29C 73/34; B29C 2035/0816; B29C 35/0805; A47J 36/2494; H01R 13/52; H01R 13/5219; C22C 38/08
USPC ..... 219/217, 201, 545, 204, 633, 634–635, 219/667, 212, 279, 638, 602–603, 618, 219/759, 528–529, 660–665; 174/126.2, 174/117 M, 126.4; 29/846; 324/658; 156/272.4; 425/174; 99/483
See application file for complete search history.

(56) References Cited

U.S. PATENT DOCUMENTS 8,330,086 B2 12/2012 Miller et al.
2002/0113066 A1* 8/2002 Stark ..... B29C 35/0272 219/634
2004/0129924 A1* 7/2004 Stark ..... B29C 35/0272 252/500
2008/0128078 A1* 6/2008 May ..... B29C 73/10 156/272.4
2008/0251642 A1* 10/2008 Boschet ..... B64D 15/12 244/134 D
2009/0314770 A1* 12/2009 LaMarca ..... B29C 65/3612 219/633
2011/0013954 A1* 1/2011 Domoto ..... G03G 15/2057 399/328
2011/0139769 A1 6/2011 Miller et al.
2012/0145702 A1 6/2012 Miller et al.
2012/0145703 A1* 6/2012 Matsen ..... B29C 73/10 219/618
2014/0231402 A1* 8/2014 Matsen ..... B29C 35/0227 219/212
2014/0363637 A1* 12/2014 Kovach ..... B29C 63/0013 428/200

OTHER PUBLICATIONS

Miller, et al.; Parallel Wire Conductor for Use With a Heating Blanket; U.S. Appl. No. 14/640,217, filed Mar. 6, 2015.
Search Report for related European Application No. EP16185341.1; report dated Apr. 4, 2017.
Office Action for related Canadian Application No. 2,941,056; report dated Jun. 18, 2019.

* cited by examiner

HIGHLY FORMABLE SMART SUSCEPTOR BLANKETS

FIELD OF THE DISCLOSURE

The present disclosure relates generally to heating blankets and, more particularly, to a heating blanket and method for heating a structure to a substantially uniform temperature across the structure.

BACKGROUND OF THE DISCLOSURE

Heating blankets can be used for many different purposes. In industrial applications, for example, heating blankets may be used in manufacturing and repair of composite structures by providing a localized application of heat. However, conventional heating blankets do not provide uniform temperatures across an area that is being heated, especially if that area has contoured surfaces. As a result, differential heating across the area causes certain spots to be over-heated while other spots are under-heated.

SUMMARY OF THE DISCLOSURE

In accordance with one embodiment, a method for heating a contoured surface is disclosed. The method may include placing on the contoured surface a heating blanket including a conductor configured to generate a magnetic field in response to an electrical current, a plurality of susceptors configured to generate heat in response to the magnetic field and composed of a magnetic material having a Curie point, and a matrix surrounding the conductor and the plurality of susceptors and composed of a material that becomes conformable at a first predetermined temperature. The method may also include providing electrical current to the heating blanket to increase a temperature of the matrix to at least the first predetermined temperature, and allowing the heating blanket to conform to the contoured surface.

In a refinement, the method may further include increasing the electrical current to the heating blanket to increase the temperature of the matrix to a second predetermined temperature.

In another refinement, the method may further include providing an uncured composite patch on the contoured surface before placing the heating blanket on the contoured surface.

In another refinement, the method may further include providing a vacuum bag assembly over the uncured composite patch and the heating blanket, and applying a vacuum to the vacuum bag assembly before providing electrical current to the heating blanket.

In another refinement, the method may further include supplying electrical current to the heating blanket to maintain the second predetermined temperature for a predetermined time period until the uncured composite patch is cured.

In accordance with another embodiment, a method for repairing a contoured surface of a structure is disclosed. The method may include inserting an uncured composite patch on the contoured surface of the structure, and placing on the uncured composite patch a heating blanket including a thermoplastic matrix, a conductor embedded in the thermoplastic matrix and configured to generate a magnetic field in response to an electrical current, and a plurality of susceptors embedded in the thermoplastic matrix, configured to generate heat in response to the magnetic field, and composed of a magnetic material having a Curie point.

The method may also include installing a vacuum bag assembly over the uncured composite patch and the heating blanket, and applying a vacuum to the vacuum bag assembly. The method may also include providing electrical current to the conductor to increase a temperature of the heating blanket to a first predetermined temperature, and continuing supply of electrical current to the conductor to maintain the first predetermined temperature such that the thermoplastic matrix becomes conformable and conforms to the contoured surface of the structure.

In a refinement, the method may further include increasing the electrical current to the conductor to increase the temperature of the heating blanket to a second predetermined temperature, and continuing supply of the increased electrical current to the conductor to maintain the second predetermined temperature for a predetermined time period to complete curing of the uncured composite patch.

In another refinement, the method may further include ceasing supply of electrical current to the conductor, allowing the temperature of the heating blanket to reach a room temperature, removing the vacuum bag assembly, and removing the heating blanket from the contoured surface of the structure.

In accordance with another embodiment, a heating blanket is disclosed. The heating blanket may include a thermoplastic matrix configured to become conformable at a predetermined temperature, a conductor embedded in the thermoplastic matrix and configured to receive electrical current and generate a magnetic field in response to the electrical current, and a plurality of susceptors embedded in the thermoplastic matrix and composed of a magnetic material having a Curie point.

In a refinement, the thermoplastic matrix may be preformed to a shape of a contoured composite structure.

In another refinement, the Curie point of the plurality of susceptors may be greater than the predetermined temperature of the thermoplastic matrix.

In another refinement, the thermoplastic matrix may be composed of polyethylene.

In another refinement, the plurality of susceptors may comprise at least a first alloy susceptor wire having a first Curie point and a second alloy susceptor wire having a second Curie point different than the first Curie point.

In another refinement, the heating blanket may further comprise reinforcing fibers configured to reduce deformation of the conductor in the thermoplastic matrix.

In another refinement, the reinforcing fibers may surround the conductor and the plurality of susceptors.

In another refinement, the conductor may comprise a plurality of Litz wires arranged in parallel, and the heating blanket may further include a plurality of threads tying the plurality of Litz wires together.

In another refinement, the conductor may comprise a plurality of Litz wires arranged in a knitted configuration.

In another refinement, the conductor may comprise a plurality of Litz wires arranged in a sine wave configuration.

In another refinement, the thermoplastic matrix may include: a first thermoplastic material embedding the conductor and the plurality of susceptors therein, and a second thermoplastic material surrounding the first thermoplastic material, the second thermoplastic material having a minimum viscosity temperature that is lower than a minimum viscosity temperature of the first thermoplastic material.

In another refinement, the heating blanket may be preformed to a shape of a contoured composite structure.

These and other aspects and features will become more readily apparent upon reading the following detailed description when taken in conjunction with the accompanying drawings. In addition, although various features are disclosed in relation to specific exemplary embodiments, it is understood that the various features may be combined with each other, or used alone, with any of the various exemplary embodiments without departing from the scope of the disclosure.

While the present disclosure is susceptible to various modifications and alternative constructions, certain illustrative embodiments thereof will be shown and described below in detail. The disclosure is not limited to the specific embodiments disclosed, but instead includes all modifications, alternative constructions, and equivalents thereof.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
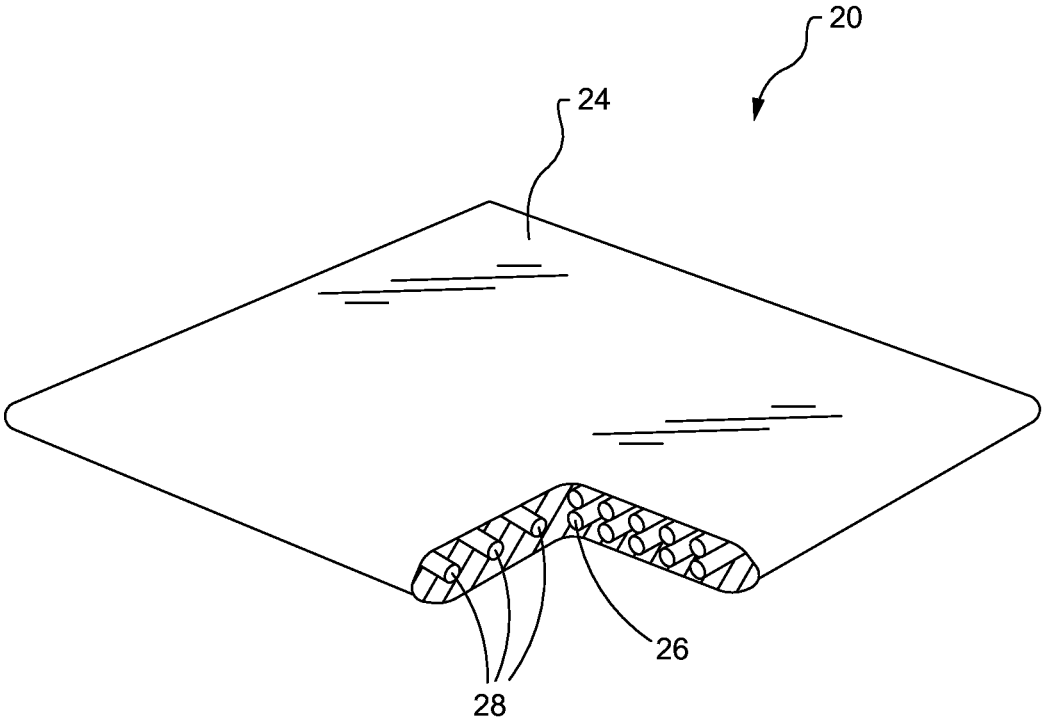
FIG. 1 is a perspective cutaway view of a heating blanket, in accordance with one embodiment of the present disclosure.
Figure 2:
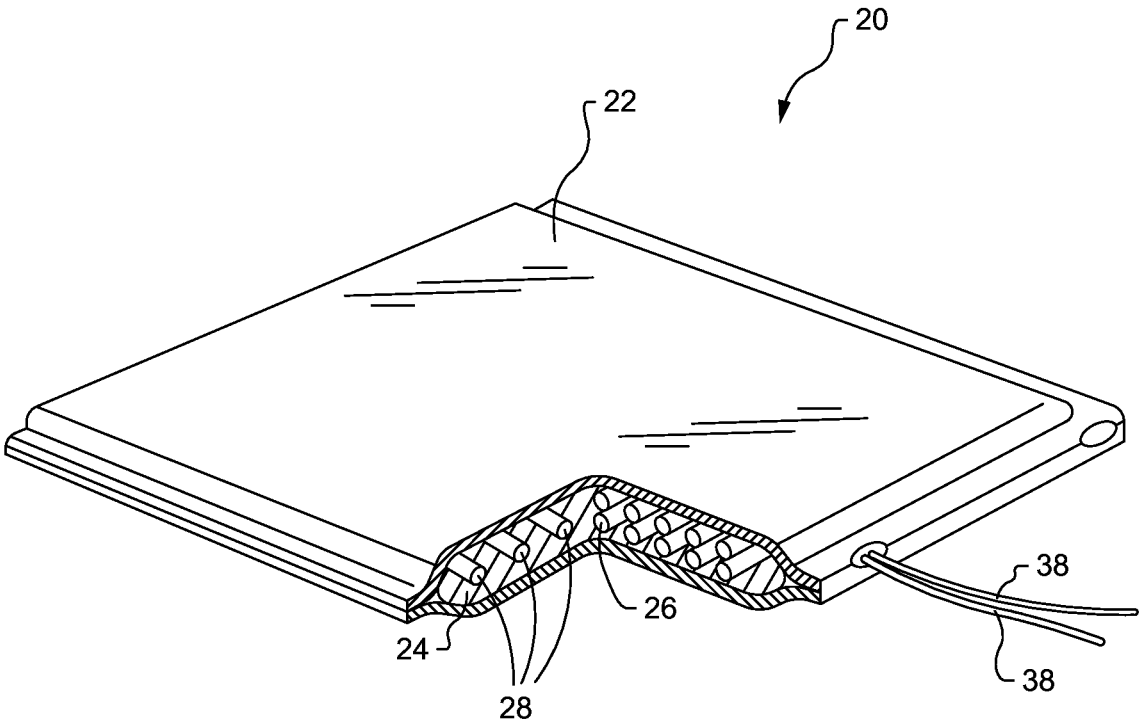
FIG. 2 is a perspective cutaway view of a heating blanket, in accordance with another embodiment.

FIG. 1 illustrates a perspective cutaway view of a heating blanket 20, in accordance with an embodiment of the present disclosure. The heating blanket 20 may comprise a matrix 24 with a conductor 26 and a plurality of susceptors 28 embedded therein. Although not required, the heating blanket 20 may also include a housing 22, as shown in FIG. 2, that contains the matrix 24. The housing 22 may be made of a same material as the matrix 24.

Referring back to FIG. 1, the matrix 24 is composed of a thermoplastic material or other suitable material that becomes conformable, pliable, or moldable above a minimum viscosity temperature and solidifies upon cooling. In addition, the thermoplastic material of the matrix 24 is thermally conductive. For example, the thermoplastic material may be polyethylene. Polyethylene has a minimum viscosity temperature between an approximate range of 210° F. to 240° F. However, other thermoplastic materials may be used. By using thermoplastic material for the matrix 24, the heating blanket 20 can stretch and conform to contoured surfaces once the minimum viscosity temperature is achieved. In so doing, the heating blanket 20 can provide uniform heat to an area to which the heating blanket 20 is applied.

Figure 3:
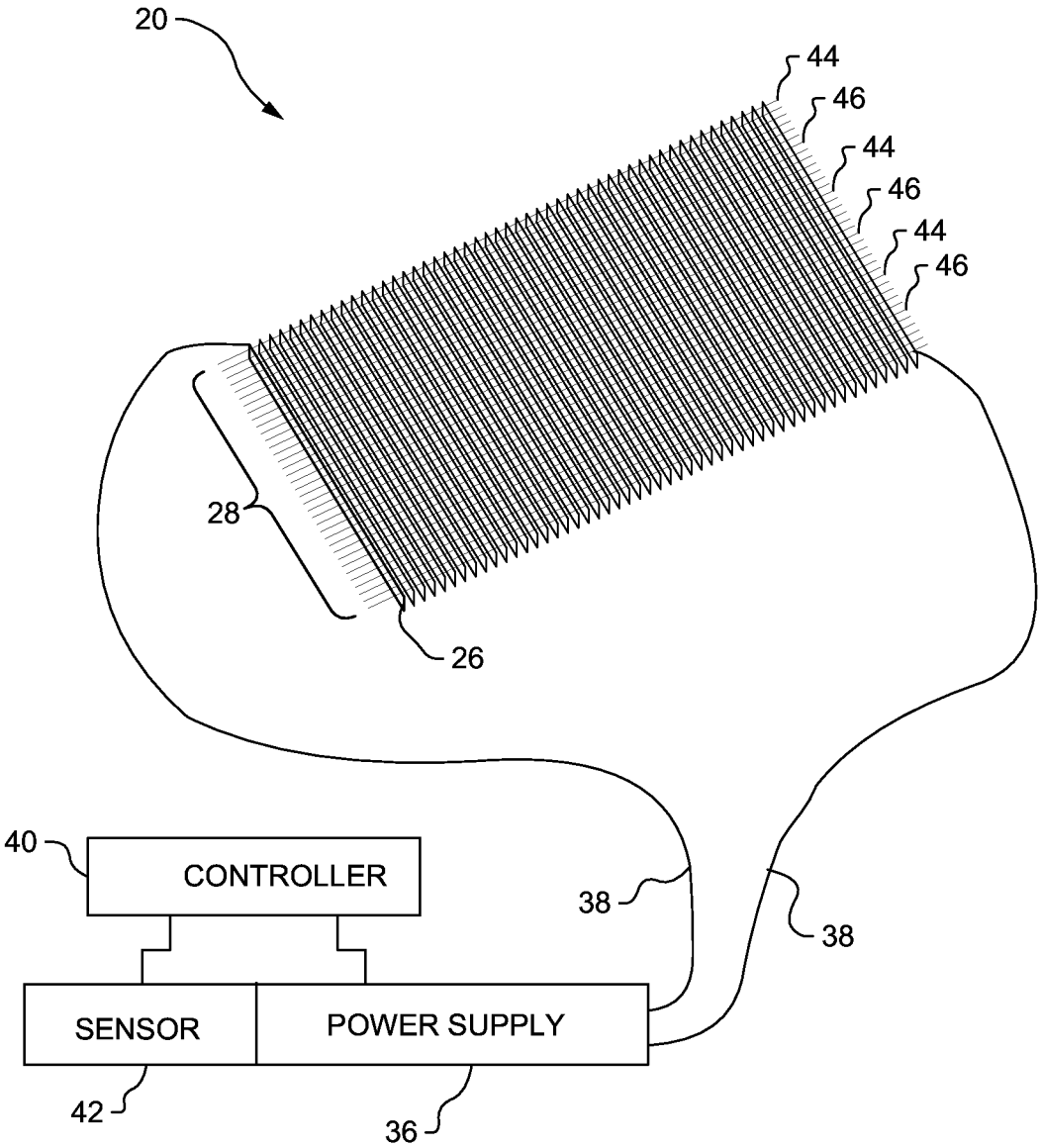
FIG. 3 is a schematic view of the heating blanket in FIG. 1 with a housing and a matrix removed.

Embedded within the matrix 24, the conductor 26 may be configured to receive an electrical current and generate a magnetic field in response to the electrical current. In one example, the conductor 26 may comprise a Litz wire, although other suitable types of conductors can be used as well. Referring now to FIG. 3, with continued reference to FIG. 1 and FIG. 2, the conductor 26 is operatively connected to a portable or fixed power supply 36, such as via wiring 38. The power supply 36 may provide alternating current electrical power to the conductor 26 and may be connected to a conventional outlet.

In addition, the power supply 36 may operate at higher frequencies. For example, the minimum practical frequency may be approximately ten kilohertz, and the maximum practical frequency may be approximately four hundred kilohertz. However, other frequencies may be used. Furthermore, the power supply 36 may be connected to a controller 40 and a voltage sensor 42 or other sensing device configured to indicate a voltage level provided by the power supply 36. Based on the indicated voltage level from the voltage sensor 42, the controller 40 may adjust the alternating current of the power supply 36 over a predetermined range in order to facilitate application of the heating blanket 20 to various heating requirements.

Also embedded within the matrix 24, the plurality of susceptors 28 are configured to generate heat in response to the magnetic field generated by the conductor 26. More specifically, the plurality of susceptors 28 absorb electromagnetic energy from the conductor 26 and convert it to heat. Furthermore, the plurality of susceptors 28 are composed of a magnetic material having a Curie point. The Curie point is a temperature at which the plurality of susceptors 28 becomes non-magnetic.

Upon approaching the Curie point, the heat generated by the plurality of susceptors 28 decreases. For example, if the Curie point of the magnetic material for the plurality of susceptors is 125° F., the plurality of susceptors 28 may generate two Watts per square inch at 100° F., may decrease heat generation to one Watt per square inch at 110° F., and may further decrease heat generation to 0.5 Watts per square inch at 120° F. As such, portions of the heating blanket 20 that are cooler due to larger heat sinks generate more heat and portions of the heating blanket 20 that are warmer due to smaller heat sinks generate less heat, thereby resulting in all portions of the heating blanket 20 arriving at approximately a same equilibrium temperature and reliably providing uniform temperature over the entire heating blanket 20.

Thus, the heating blanket 20 may provide uniform application of heat to the area to which the heating blanket 20 is applied, compensating for heat sinks that draw heat away from portions of the area that is being heated. The plurality of susceptors 28 will continue to heat portions of the area that have not reached the Curie point, while at the same time, ceasing to provide heat to portions of the area that have reached the Curie point. In so doing, the temperature-dependent magnetic properties, such as the Curie point of the magnetic material used in the plurality of susceptors 28, may prevent over-heating or under-heating of areas to which the heating blanket 20 is applied.

The magnetic material of the plurality of susceptors 28 may be provided in a variety of compositions, such as a metal, an alloy, a metal oxide, a ferrite, and any other suitable material having a Curie point that approximates any desired temperature. Although other predetermined arrangements may be used, the magnetic material of the plurality of susceptors 28 may be chosen such that the Curie point is above the desired temperature of the heating application in order to generate sufficient heat at the desired temperature to overcome average heat loss. For instance, the plurality of susceptors 28 may comprise a plurality of alloy susceptor wires. However, other configurations for the plurality of susceptors 28 may be used.

In one example, the plurality of susceptors 28 may be composed of Alloy 32, which has 32% Ni and 68% Fe and provides uniform temperatures compensating for heat sinks in the range of about 240° F. to 300° F. In other examples, the magnetic material of the plurality of susceptors 28 may comprise Alloy 30, which has 30% Ni and 70% Fe for a desired temperature of about 100° F., or Alloy 34, which has 34% Ni and 66% Fe for a desired temperature of about 400° F. However, other compositions may be used for the magnetic material of the plurality of susceptors 28. In addition, the heat generation of the plurality of susceptors 28 may also depend on a diameter of each wire.

Moreover, the plurality of susceptors 28 may include two or more different magnetic materials. For example, the plurality of susceptors 28 may include a plurality of first susceptors 44 composed of a first magnetic material and a plurality of second susceptors 46 composed of a second magnetic material. The first magnetic material of the plurality of first susceptors 44 may have a different Curie point than a Curie point of the second magnetic material of the plurality of second susceptors 46. By incorporating different magnetic materials having different Curie points into the plurality of susceptors 28, increased temperature regulation over a wider range of temperatures may be achieved.

Furthermore, the thermoplastic material of the matrix 24 may be matched with a compatible magnetic material for the plurality of susceptors 28. More specifically, the Curie point of the magnetic material of the plurality of susceptors 28 may be greater than or at least equal to the minimum viscosity temperature at which the thermoplastic material of the matrix 24 becomes conformable, pliable, or moldable. In so doing, the plurality of susceptors 28 heats the matrix 24 to the minimum viscosity temperature such that the matrix can conform to contoured surfaces, thereby applying uniform temperature to the structure being heated.

In addition, the magnetic material of the plurality of susceptors 28 may be matched to the application or use of the heating blanket 20. More specifically, the Curie point of the plurality of susceptors 28 may be matched to the desired temperature of the induction heating operation being performed. For example, the plurality of susceptors 28 may be formed of magnetic materials having Curie points in the range of the curing temperature of the adhesive, epoxy, or composite material, which the heating blanket 20 is being used to heat.

The conductor 26 and the plurality of susceptors 28 may be provided in a variety of configurations within the matrix 24. For example, as shown in FIG. 3, the conductor 26 may be arranged as a flattened helical wire, such as a Litz wire that is wound in a flattened helical or solenoid structure, so as to define a plurality of alternating conductor portions. In the example, the plurality of susceptors 28 may be arranged as a linear wire array positioned within the alternating conductor portions of the flattened helical wire.

For instance, susceptor wires of the linear wire array may be arranged perpendicular to conductor portions of the flattened helical wire such that a longitudinal axis of the susceptor wires resides substantially perpendicular to an electrical current flowing through the flattened helical wire. In the presence of an electrical current provided by the power supply 36, the plurality of susceptors 28 are positioned between alternating conductor portions of the conductor 26 for inductive heating of the plurality of susceptors 28. The inductively heated plurality of susceptors 28 thermally conducts heat to the matrix 24, which thermally conducts heat to a structure to which the heating blanket 20 is mounted.

Figure 4:
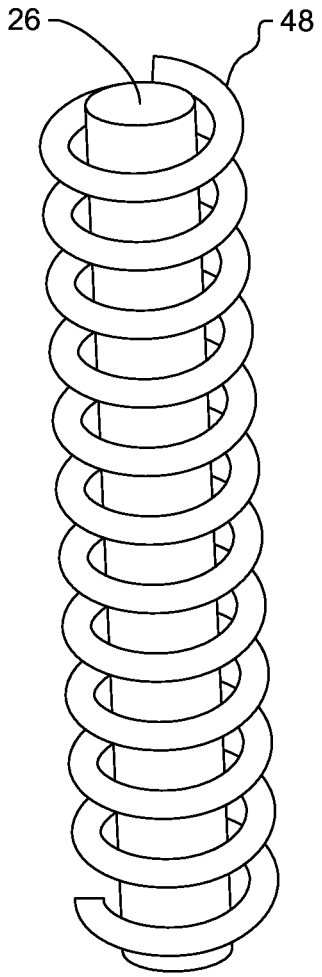
FIG. 4 is a side view of a conductor and susceptor arrangement that may be used in a heating blanket, in accordance with another embodiment.

In another example, the plurality of susceptors 28 may be formed as a solid or unitary component in a cylindrical arrangement. For instance, as shown in FIG. 4, a susceptor 48 can be configured as a spiral or spring around the conductor 26 in order to enhance the flexibility of the heating blanket 20. However, other arrangements of the conductor 26 and the plurality of susceptors 28 may be used.

Figure 5:
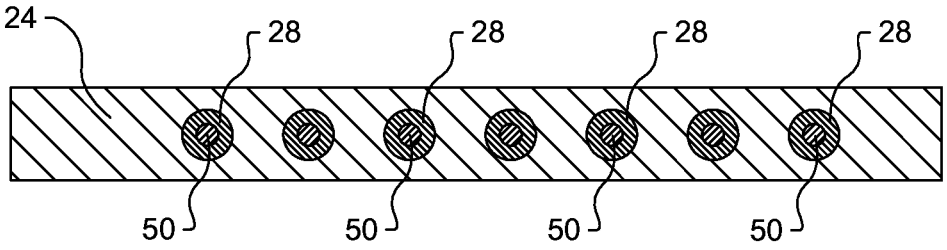
FIG. 5 is a cross-sectional view of a heating blanket, in accordance with another embodiment.

In addition, the conductor 26 may comprise a plurality of conductors which are electrically connected in parallel in order to minimize a magnitude of the voltage required for large sized heating blankets. For instance, as shown in FIG. 5, the conductor 26 may comprise a plurality of Litz wires 50 arranged parallel to each other. In the example, the plurality of susceptors 28 comprise a woven fabric of susceptor wires surrounding and substantially aligned circumferentially around each of the Litz wires 50. The woven fabric of susceptor wires may include other non-electrically conducting threads to form a reinforcing fabric sleeve around each of the Litz wires 50.

Figure 6:
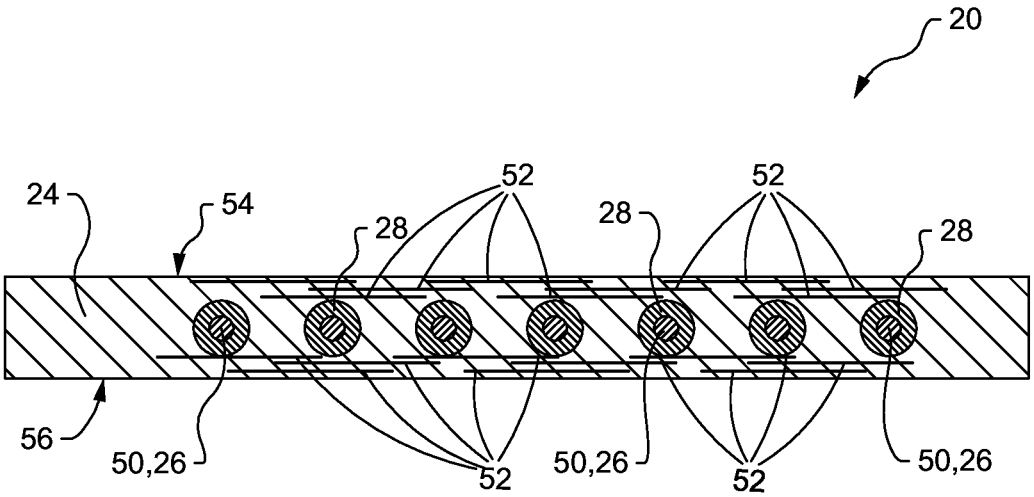
FIG. 6 is a cross-sectional view of a heating blanket with reinforcing fibers, in accordance with another embodiment.

Turning now to FIG. 6, with continued reference to FIGS. 1-5, the heating blanket 20 is reusable and may contain structural elements, such as reinforcing fibers 52, to support the reusability of the matrix 24. The reinforcing fibers 52 are used to reduce deformation of the conductor 26 and the plurality of susceptors 28 within the matrix 24. In addition, the reinforcing fibers 52 may allow the matrix 24 to be conformable in one direction and non-conformable in an opposite direction, depending on the placement of the reinforcing fibers 52 within the matrix 24. For example, when the matrix 24 is heated to the minimum viscosity temperature of the thermoplastic material such that the matrix 24 stretches and conforms to the part the heating blanket 20 is applied to, the conductor 26 and the plurality of susceptors 28 may move, stretch, or deform within the matrix 24. After the matrix 24 cools and becomes solid again, the conductor 26 and the plurality of susceptors 28 may be in a different location within the matrix 24 than originally positioned before heating of the matrix 24 to the minimum viscosity temperature of the thermoplastic material.

The reinforcing fibers 52 may be disposed in the matrix 24, such as surrounding the conductor 26 and the plurality of susceptors 28 proximate surfaces 54, 56 of the matrix 24. In so doing, the reinforcing fibers 52 help prevent the conductor 26 and the plurality of susceptors 28 from breaking through the matrix 24. For instance, the reinforcing fibers 52 may comprise nylon wires, polyester wires, and other types of plastic or textile materials. However, any suitable non-plastic or non-textile materials may be used for the reinforcing fibers 52 as well. The reinforcing fibers 52 may be arranged unidirectional, woven or fabric, random or discontinuous fiber mat, or any other suitable arrangement. Furthermore, the housing 22 may contain reinforcing fibers 52 in addition to or instead of the matrix 24. The reinforcing fibers 52 may serve as a barrier to reinforce surfaces 54, 56, while still allowing conformability of the thermoplastic matrix 24.

Figure 7:
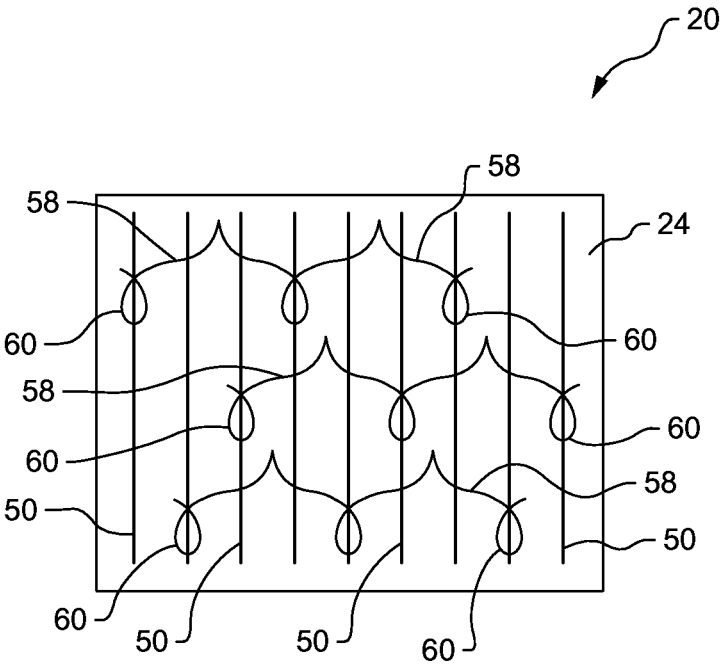
FIG. 7 is a schematic view of a plurality of Litz wires tied together by threads in a heating blanket, in accordance with another embodiment.
Figure 8:
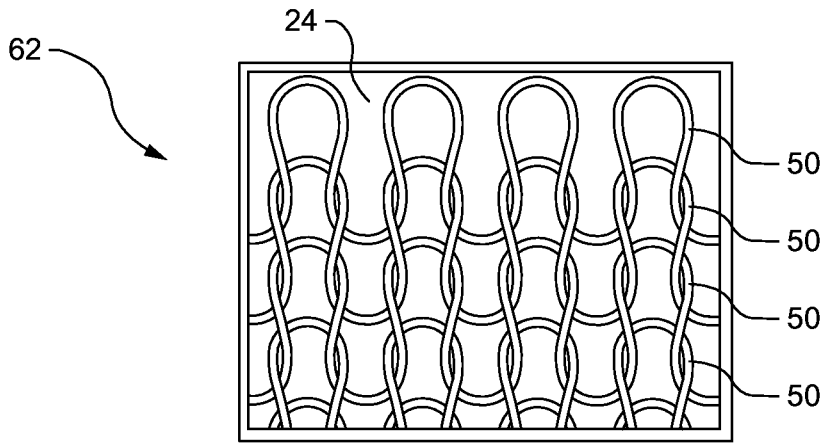
FIG. 8 is a schematic view of a plurality of Litz wires in a knitted configuration, in accordance with another embodiment.
Figure 9:
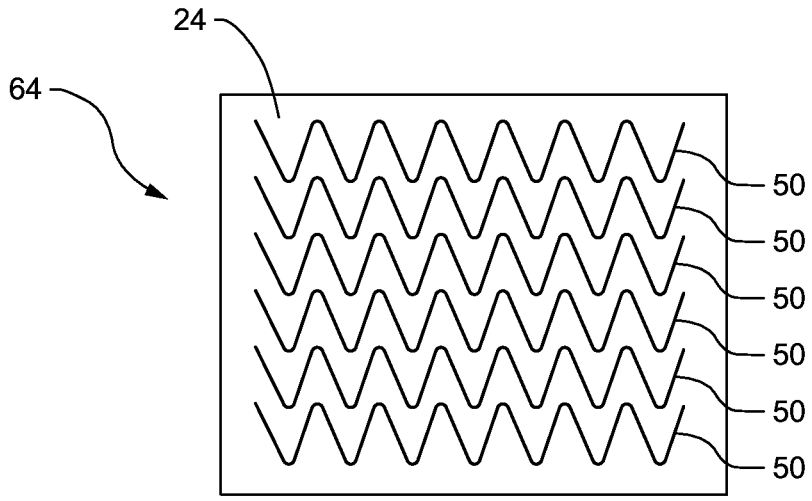
FIG. 9 is a schematic view of a plurality of Litz wires in a sine wave configuration, in accordance with another embodiment.

Referring now to FIGS. 7-9, with continued reference to FIGS. 1-6, the heating blanket 20 may include other structural elements to support reusability, such as textile features 58, 62, 64. More specifically, as shown in FIG. 7, a plurality of threads 58 composed of nylon, or other suitable materials, are disposed across the Litz wires 50 and tied to the Litz wires 50, such as via knots 60. As shown in FIG. 8, the Litz wires 50 may be interlaced together in a knitted configuration 62. The threads 58 and the knitted configuration 62 may tie the Litz wires 50 together and help contain them within the matrix 24.

As shown in FIG. 9, the Litz wires 50 may be formed in a sine wave configuration 64, or other suitable pattern. The sine wave configuration 64, as well as the threads 58 and the knitted configuration 62, help limit deformation by accommodating stretching of the matrix 24. More specifically, such features may provide additional elasticity and spring-back through the conductor 26 and the plurality of susceptors 28 embedded within the matrix 24. Although in FIGS. 7-9, the Litz wires 50 are shown and described as incorporating the textile features 58, 62, 64, the plurality of susceptors 28 may incorporate the textile features 58, 62, 64 in addition to or instead of the Litz wires 50.

Figure 10:
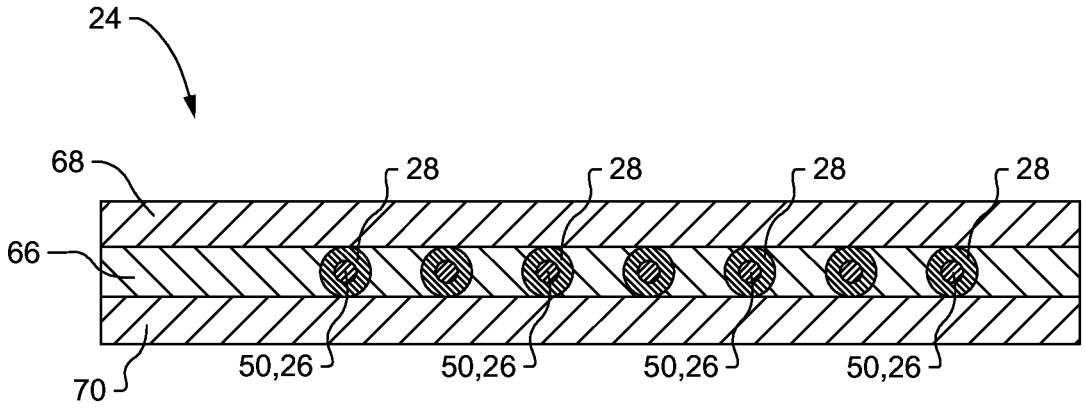
FIG. 10 is a cross-sectional view of a heating blanket with various thermoplastic layers, in accordance with another embodiment.

Turning now to FIG. 10, with continued reference to FIGS. 1-9, the matrix 24 may include various layers 66, 68, 70 of thermoplastics having different melting properties. For example, the conductor 26 and the plurality of susceptors 28 may be embedded in the internal layer 66, while surface layers 68, 70 may surround and encapsulate the internal layer 66. In the example, the internal layer 66 is composed of a first thermoplastic material, and the surface layers 68, 70 are composed of a second thermoplastic material that is different from the first thermoplastic material.

More specifically, the first thermoplastic material and the second thermoplastic material may have different minimum viscosity temperatures at which each material becomes conformable, pliable, or moldable. For instance, the minimum viscosity temperature of the first thermoplastic material in the internal layer 66 may be greater than the minimum viscosity temperature of the second thermoplastic material in the surface layers 68, 70. In so doing, the surface layers 68, 70 may become conformable at a lower temperature than the internal layer. At the lower temperature, as the surface layers 68, 70 conform to the contoured surfaces of the part being heated by the heating blanket 20, the internal layer 66 may retain its shape, thereby minimizing deformation of the matrix 24 while still providing uniform heat to the part.

Figure 11:
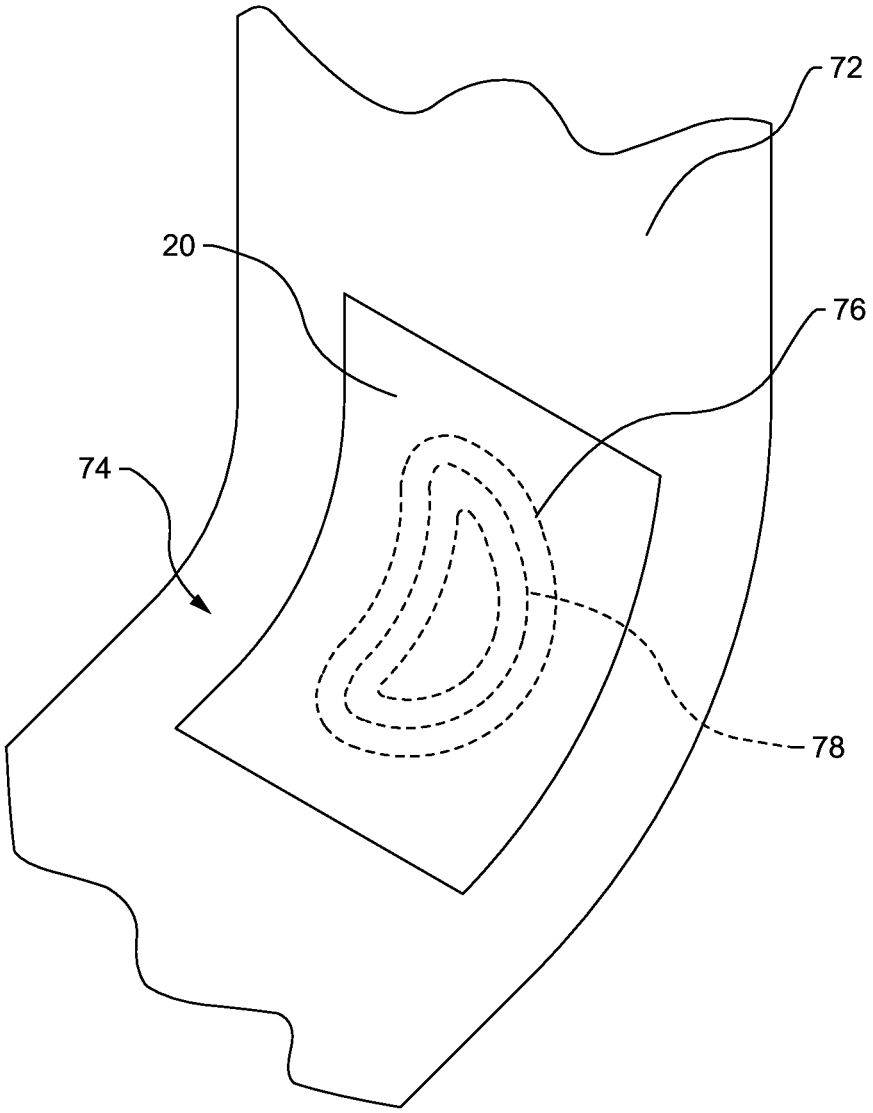
FIG. 11 is side view of a heating blanket applied to a rework area of a composite structure, in accordance with another embodiment.
Figure 12:
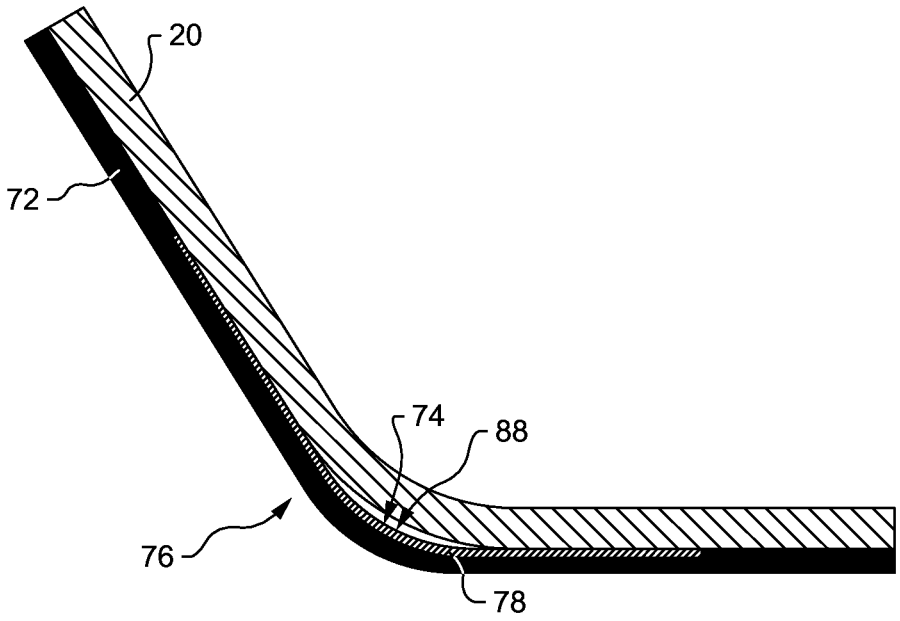
FIG. 12 is a cross-sectional view of the heating blanket applied to the rework area of the composite structure in FIG. 11.

Referring now to FIGS. 11 and 12, with continued reference to FIGS. 1-10, the heating blanket 20 may be mounted to a structure 72, such as a composite structure, having at least one contoured surface 74. The heating blanket 20 may be used to apply uniform heat to a rework area 76 on the contoured surface 74 of the structure 72. For example, the heating blanket 20 may apply heat to cure an adhesive bonding a patch 78, such as an uncured composite patch or other type or patch, to the rework area 76 and/or to heat composite material in the rework area 76. However, the heating blanket 20 may be used to apply uniform heat to non-contoured surfaces of the structure 72 and to other non-repair applications as well.

Figure 13:
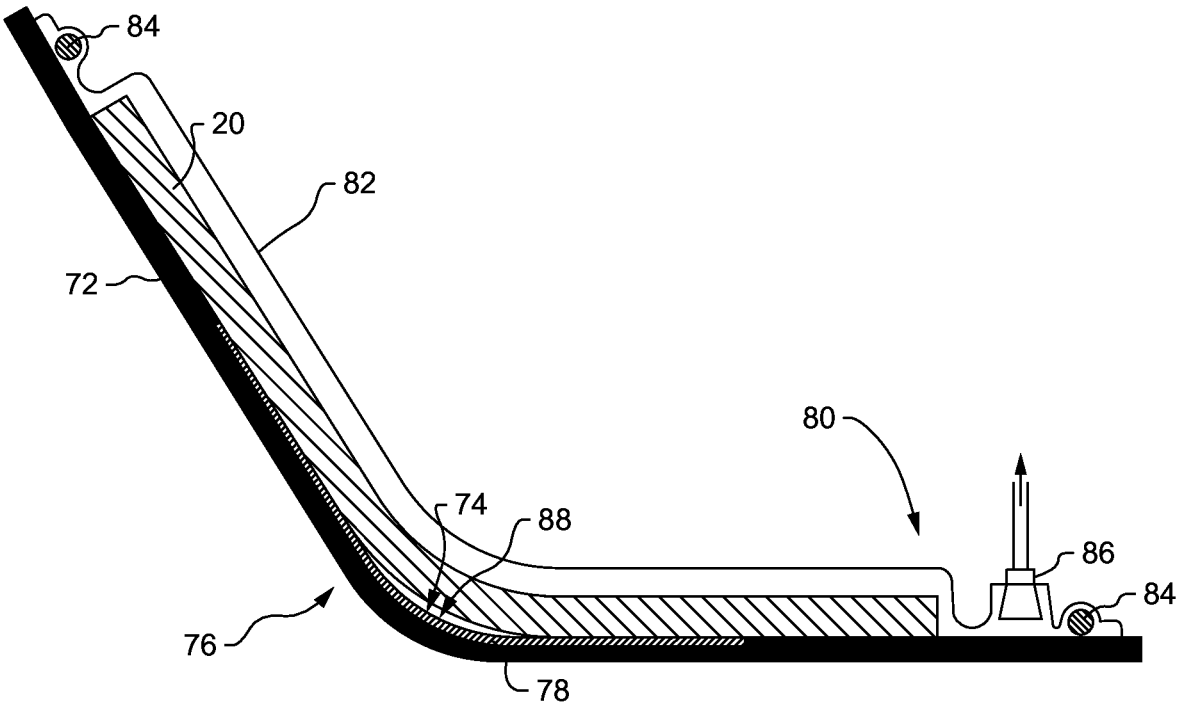
FIG. 13 is a cross-sectional view of a vacuum bag assembly installed over the heating blanket and rework area of the composite structure in FIG. 12.

Turning now to FIG. 13, with continued reference to FIGS. 1-12, a vacuum bag assembly 80 may be installed over the heating blanket 20 to apply pressure to the heating blanket 20, such as prior to supplying electrical current to the heating blanket 20. The vacuum bag assembly 80 may include a bagging film 82 covering the heating blanket 20. The bagging film 82 may be sealed to the contoured surface 74 of the structure 72 by means of a sealant 84, and a vacuum probe 86 may extend from the bagging film 82 to a vacuum generator to apply a vacuum on the bagging film 82.

Figure 14:
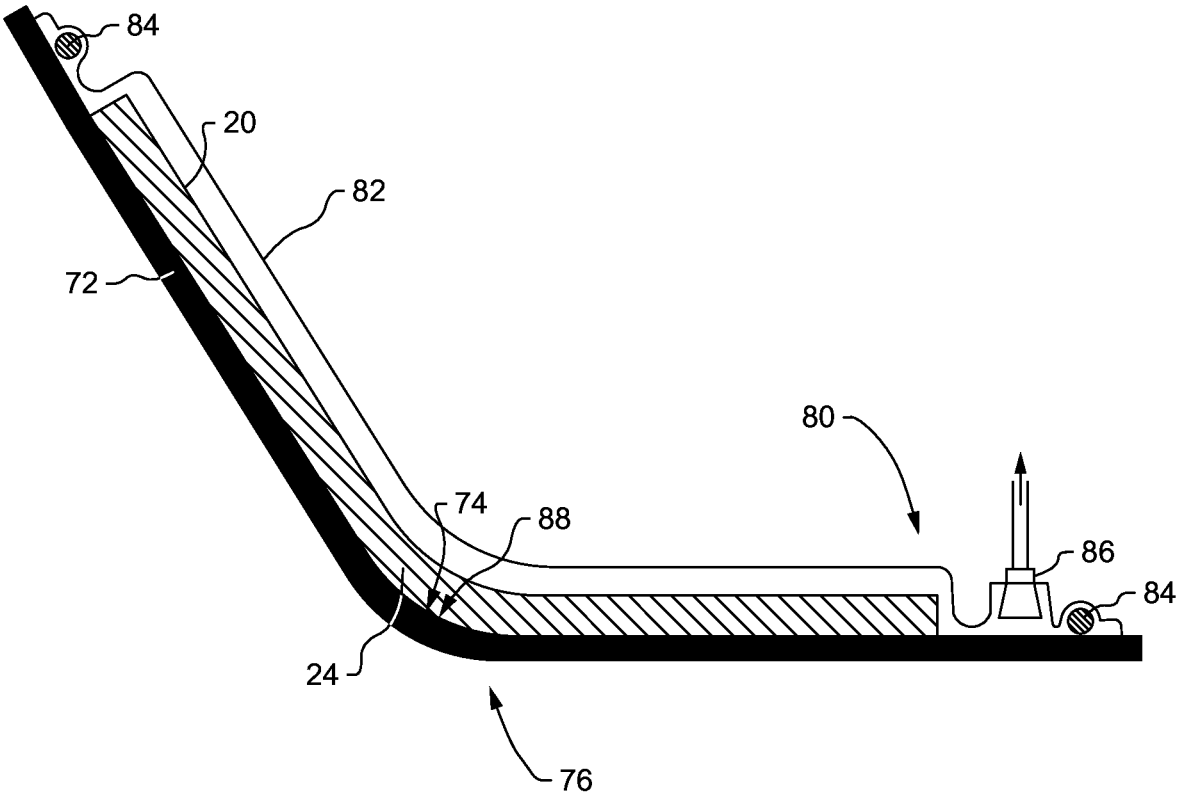
FIG. 14 is a cross-sectional view of the heating blanket conformed to a contoured surface of the composite structure in FIG. 12.

After vacuum pressure is applied via the vacuum bag assembly 80 to the heating blanket 20 on the contoured surface 74 of the structure 72, for example, the heating blanket 20 may still need to stretch and conform to a radius of curvature 88 of the contoured surface 74. The thermoplastic material of the matrix 24 may provide the necessary elasticity to stretch and conform to the radius of curvature 88 upon heating of the matrix 24 to the minimum viscosity temperature by the plurality of susceptors 28. For instance, if the radius of curvature 88 may be 0.1 inches, and the elasticity of the matrix 24 is about thirty percent, the heating blanket 20 can sufficiently stretch and conform to the radius of curvature 88, as shown in FIG. 14, thereby providing uniform heat across the entire rework area 76 on the contoured surface 74. With vacuum pressure, all portions of the rework area 76 may be in contact with the heating blanket 20 and receive the same temperature.

Figure 15:
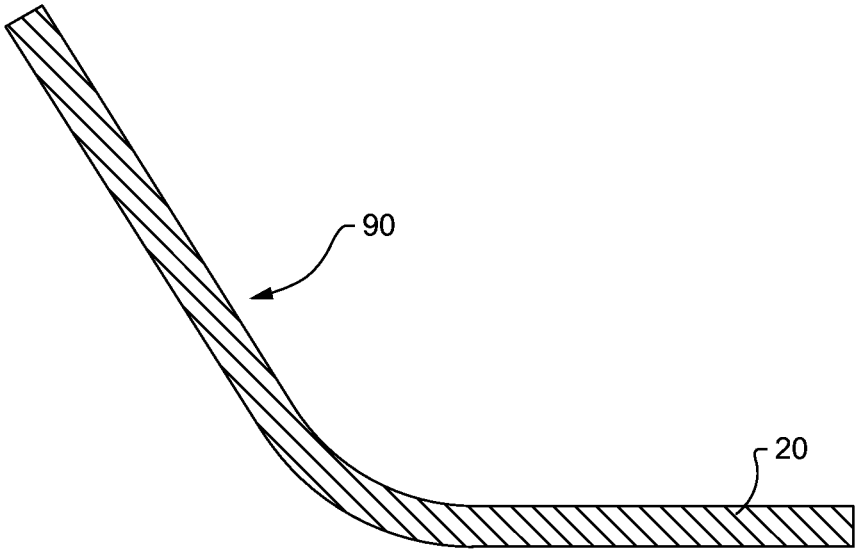
FIG. 15 is a side view of a preformed heating blanket, in accordance with another embodiment.

Referring now to FIG. 15, with continued reference to FIGS. 1-14, the heating blanket 20 may be preformed in an approximate shape of 90 the structure 72. For example, the matrix 24 may be heated and formed to the approximate shape 90 of the contoured surface 74, then allowed to cool such that at room temperature the heating blanket 20 retains the preformed shape 90. In the example where the radius of curvature 88 is 0.1 inches, for instance, the heating blanket 20 may have a preformed radius of curvature of 0.5 inches. However, other preformed shapes and dimensions for the matrix 24 and the heating blanket 20 may be used. Moreover, the heating blanket 20 may be applied to various curvatures and contours than that shown in FIGS. 11-14. The heating blanket 20 with the preformed shape 90 or preformed curvature may require less conformability to match the contour of the structure 72 to which the heating blanket is applied.

In general, the foregoing disclosure provides numerous technical effects and benefits in various applications relating to heating blankets. Particularly, the foregoing disclosure provides a highly formable smart susceptor heating blanket. For example, the disclosed heating blanket can be used in industrial applications during manufacturing and repair of composite structures, and in other applications. The disclosed heating blanket provides uniform, controlled heating of surface areas, such as contoured surface areas.

More specifically, the thermoplastic material of the heating blanket matrix provides elasticity and stretching to conform to contoured surfaces in order to uniformly contact the structure being heated. In addition, the Curie point of the magnetic material in the plurality of susceptors is used to control temperature uniformity in the area to which the heating blanket is applied. With vacuum pressure, all portions of the area being heated may be in contact with the heating blanket and achieve the same temperature, thereby helping to prevent over-heating or under-heating of certain portions of the area being heated. Furthermore, structural elements, such as reinforcing fibers, textile features, and/or layered thermoplastics, may help limit deformation of the matrix and support the reusability of the heating blanket for multiple applications.

Figure 16:
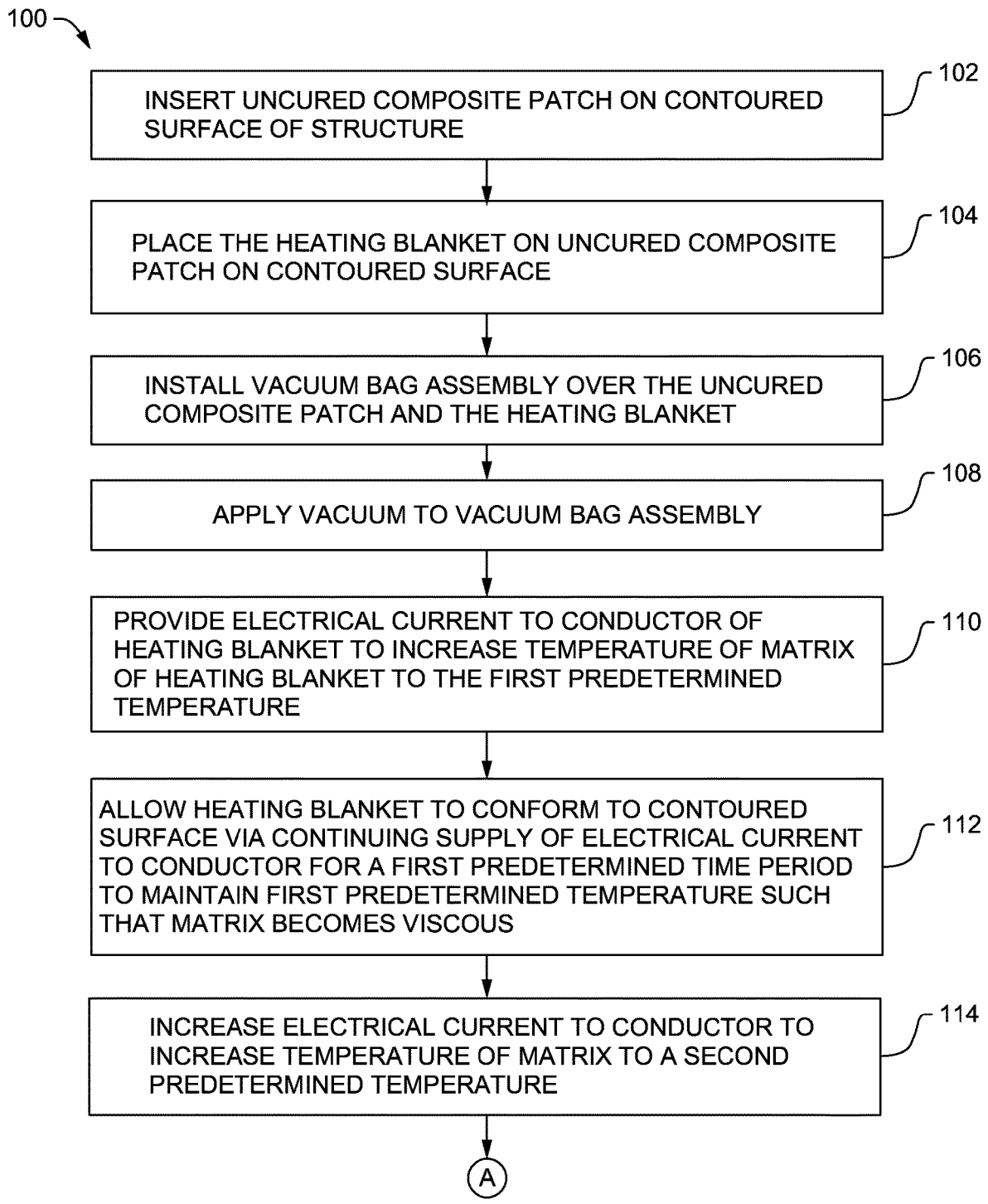
FIGS. 16 and 17 are a flowchart illustrating a process for heating a contoured surface of a structure, such as for repairing the contoured surface, in accordance with another embodiment.
Figure 17:
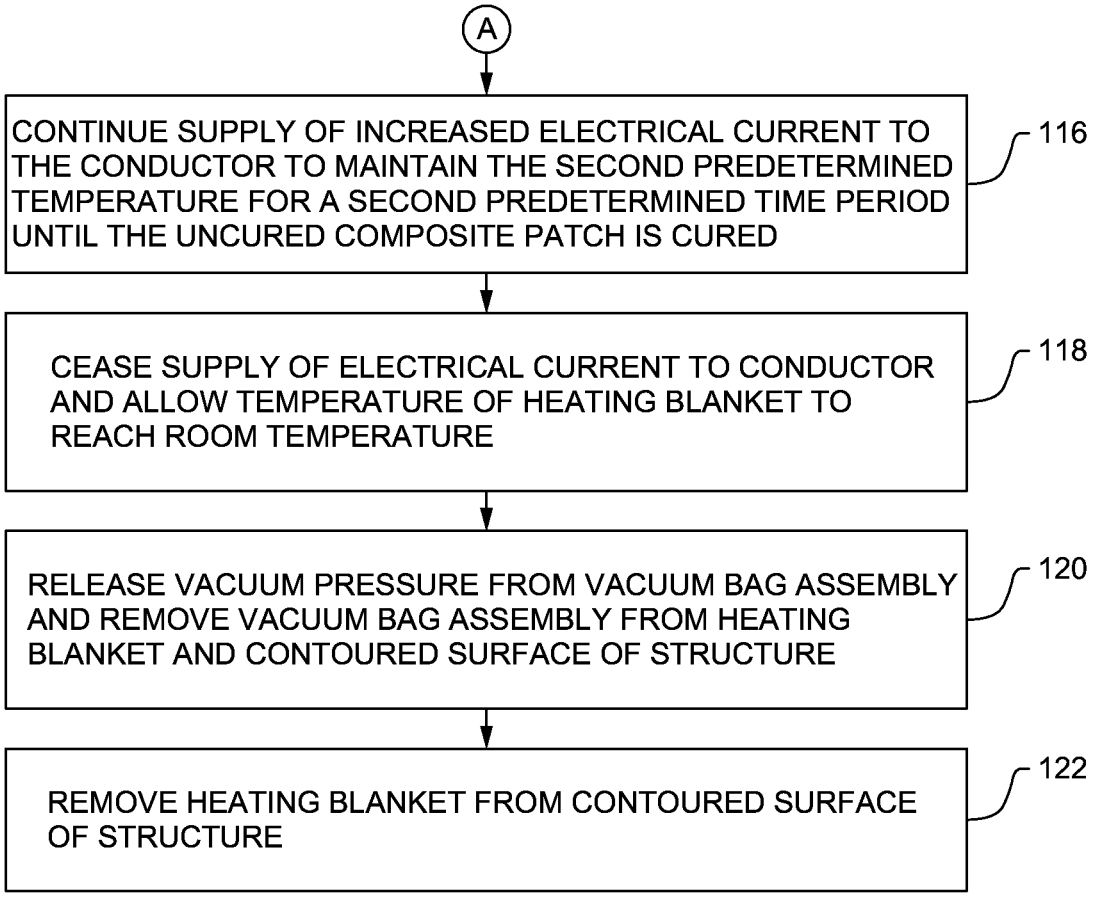

Referring now to FIGS. 16 and 17, with continued reference to FIGS. 1-15, a process 100 for heating a contoured surface 74 of a structure 72, such as for repairing the contoured surface 74, is disclosed, in accordance with another embodiment. At block 102, an uncured composite patch 78 is provided or inserted on the contoured surface 74 of the structure 72. At block 104, a heating blanket 20 is placed on the uncured composite patch 78 on the contoured surface 74.

The heating blanket 20 includes a conductor 26 configured to generate a magnetic field in response to an electrical current and a plurality of susceptors 28 configured to generate heat in response to the magnetic field and composed of a magnetic material having a Curie point. The heating blanket 20 also includes a matrix 24 surrounding and embedding the conductor 26 and the plurality of susceptors 28. The matrix is composed of a material that becomes conformable at a first predetermined temperature, such as a thermoplastic material. The first predetermined temperature may be a minimum viscosity temperature of the material.

At block 106, a vacuum bag assembly 80 is provided or installed over the uncured composite patch 78 and the heating blanket 20. A vacuum is applied to the vacuum bag assembly 80, at block 108. Electrical current is provided to the conductor 26 of the heating blanket 20, at block 110, to increase a temperature of the matrix 24 of the heating blanket 20 to at least the first predetermined temperature. At block 112, the heating blanket 20 is allowed to conform to the contoured surface 74. Supply of the electrical current to the conductor 26 of the heating blanket 20 may be continued for a first predetermined time period to maintain the first predetermined temperature and to allow the matrix 24 of the heating blanket 20 to become conformable, stretch and conform to the contoured surface 74 of the structure 72.

The electrical current to the conductor 26 of the heating blanket 20 is increased, at block 114, in order to increase the temperature of the matrix 24 to a second predetermined temperature. The second predetermined temperature may be a desired temperature of the heating operation, such as a curing temperature of the uncured composite patch 78. Supply of the increased electrical current to the conductor 26 of the heating blanket 20 may be continued to maintain the second predetermined temperature for a second predetermined time period until the uncured composite patch 78 is cured, at block 116.

Furthermore, it is not necessary to maintain supply of the electrical current for the first predetermined time period and/or the second predetermined time period in order to achieve the predetermined temperatures. To achieve a similar effect, the heating blanket 20 may include two or more different magnetic materials in the plurality of susceptors 28 for increased temperature regulation over a wider range of temperatures. Moreover, instead of having predetermined time periods, the heating blanket 20 may be heated from a start temperature, such as room temperature, to a final temperature at a steady rate that allows for the matrix 24 to conform to the structure 72 as the heating blanket 20 steadily increases to the final temperature.

At block 118, supply of electrical current to the conductor 26 of the heating blanket 20 is ceased, and the temperature of the heating blanket 20 is allowed to cool or reach a room temperature. The vacuum pressure may be released from the vacuum bag assembly 80, and the vacuum bag assembly is removed from the heating blanket 20 and the contoured surface 74 of the structure 72, at block 120. At block 122, the heating blanket 20 is removed from the contoured surface 74 of the structure 72.

Figure 18:
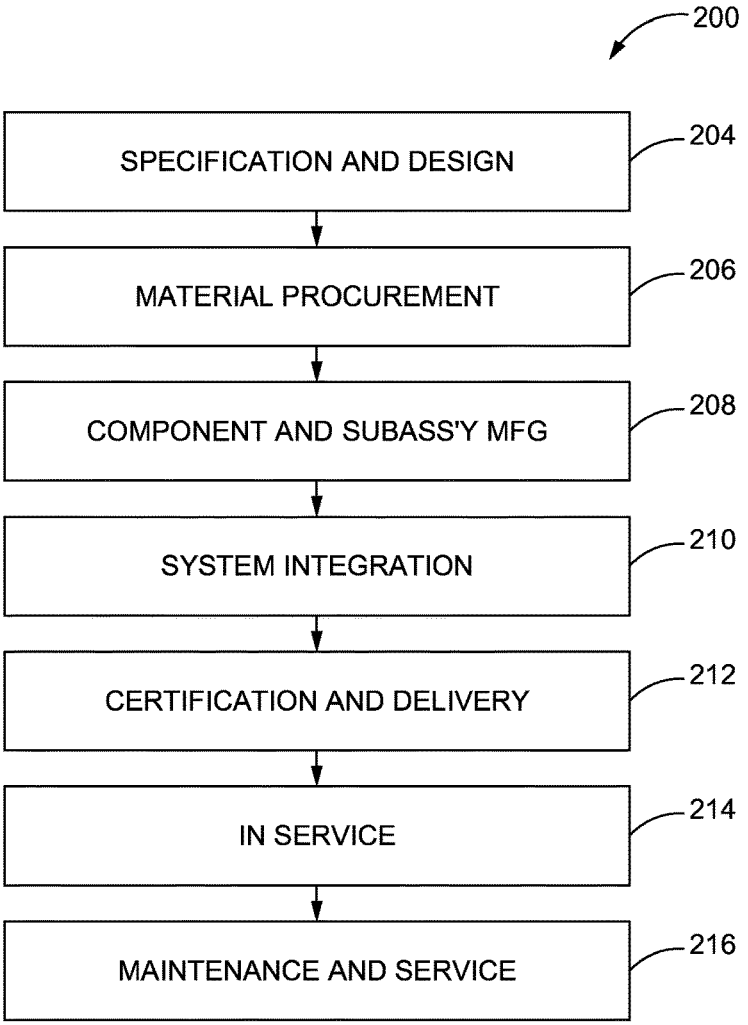
FIG. 18 is a flow diagram of aircraft production and service methodology.
Figure 19:
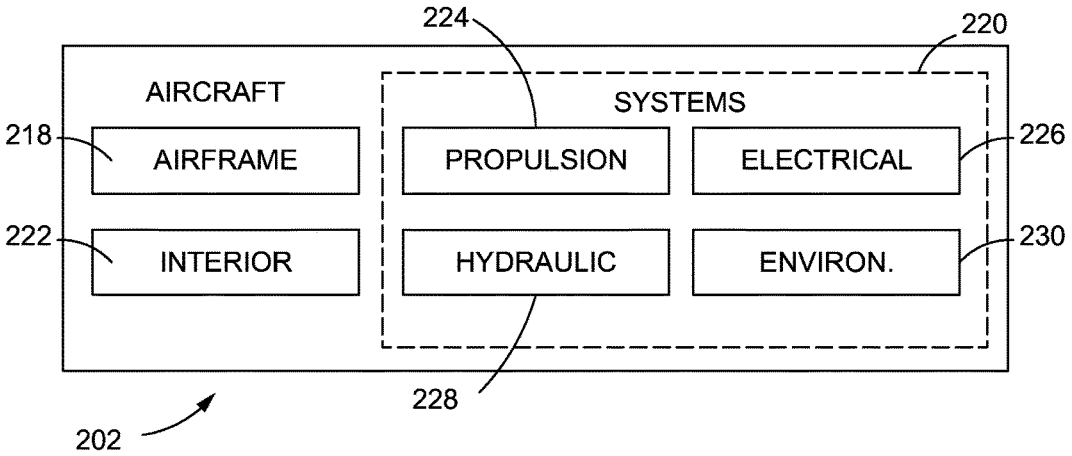
FIG. 19 is a block diagram of an aircraft.

Furthermore, embodiments of the disclosure may be described in the context of an aircraft manufacturing and service method 200 as shown in FIG. 18 and an aircraft 202 as shown in FIG. 19. For example, the heating blanket 20 may be used during component manufacturing 208 or during maintenance and service 216 for repair applications. More specifically, during pre-production, exemplary method 200 may include specification and design 204 of the aircraft 202 and material procurement 206. During production, component and subassembly manufacturing 208 and system integration 210 of the aircraft 202 takes place. Thereafter, the aircraft 202 may go through certification and delivery 212 in order to be placed in service 214. While in service by a customer, the aircraft 202 is scheduled for routine maintenance and service 216 (which may also include modification, reconfiguration, refurbishment, and so on).

Each of the processes of method 200 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 19, the aircraft 202 produced by exemplary method 200 may include an airframe 218 with a plurality of systems 220 and an interior 222. Examples of high-level systems 220 include one or more of a propulsion system 224, an electrical system 226, a hydraulic system 228, and an environmental system 230. Any number of other systems may be included. Although an aerospace example is shown, the principles of the invention may be applied to other industries, such as the automotive industry.

Apparatus and methods embodied herein may be employed during any one or more of the stages of the production and service method 200. For example, components or subassemblies corresponding to production process 208 may be fabricated or manufactured in a manner similar to components or subassemblies produced while the aircraft 202 is in service. Also, one or more apparatus embodiments, method embodiments, or a combination thereof may be utilized during the production stages 208 and 210, for example, by substantially expediting assembly of or reducing the cost of an aircraft 202. Similarly, one or more of apparatus embodiments, method embodiments, or a combination thereof may be utilized while the aircraft 202 is in service, for example and without limitation, to maintenance and service 216.

It is to be understood that the flowcharts in FIGS. 16-18 are shown and described as an example only to assist in disclosing the features of the disclosed system and techniques, and that more or less steps than that shown may be included in the process corresponding to the various features described above for the disclosed system without departing from the scope of the disclosure.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A heating blanket, comprising:

a thermoplastic matrix that is configured to change from a solid state to a pliable state, in which the thermoplastic matrix is configured to stretch and become conformable to a contoured surface, when heated to a first predetermined temperature that is below a melting temperature of the thermoplastic matrix and that is configured to re-solidify upon cooling;

a conductor wire embedded in the thermoplastic matrix and configured to receive an electrical current and generate a magnetic field in response to the electrical current; and a susceptor wire embedded in the thermoplastic matrix and composed of a magnetic material having a Curie point, wherein:

the magnetic material of the susceptor wire is selected such that the Curie point of the magnetic material is equal to or greater than the first predetermined temperature and is below the melting temperature of the thermoplastic matrix;

the susceptor wire is responsive to the magnetic field generated by the conductor wire to uniformly heat the thermoplastic matrix to a heated temperature that is above the first predetermined temperature and that is below or equal to the Curie point; and the thermoplastic matrix includes:

a first thermoplastic material embedding the conductor wire and the susceptor wire therein, the first thermoplastic material being configured to change from a solid state to a pliable state when heated to the first predetermined temperature, and a second thermoplastic material surrounding the first thermoplastic material, the second thermoplastic material being configured to change from a solid state to a pliable state when heated to a second predetermined temperature that is lower than the first predetermined temperature of the first thermoplastic material.

2. The heating blanket of claim 1, wherein the thermoplastic matrix is preformed to an approximate shape of a contoured composite structure.

3. The heating blanket of claim 1, wherein the thermoplastic matrix is composed of polyethylene.

4. The heating blanket of claim 1, wherein the susceptor wire comprises at least a first alloy susceptor wire material having a first Curie point and a second alloy susceptor wire material having a second Curie point different than the first Curie point.

5. The heating blanket of claim 1, wherein the conductor wire comprises a plurality of Litz wires arranged in parallel and including a plurality of threads tying the plurality of Litz wires together.

6. The heating blanket of claim 1, wherein the conductor wire comprises a plurality of Litz wires arranged in a knitted configuration.

7. The heating blanket of claim 1, wherein the conductor wire comprises a plurality of Litz wires arranged in a sine wave configuration.

8. The heating blanket of claim 1, wherein the heating blanket is preformed to an approximate shape of a contoured composite structure.

9. A heating blanket, comprising:

a thermoplastic matrix that is configured to change from a solid state to a pliable state, in which the thermoplastic matrix is configured to stretch and become conformable to a contoured surface, when heated to a first predetermined temperature that is below a melting temperature of the thermoplastic matrix, and that is configured to re-solidify upon cooling;

a conductor wire having a plurality of Litz wires arranged in a sine wave configuration, the conductor wire configured to receive an electrical current and generate a magnetic field in response to the electrical current; and a susceptor wire composed of a magnetic material having a Curie point and wrapped around the conductor wire in a spiral configuration, wherein:

the conductor wire and the susceptor wire are embedded in the thermoplastic matrix;

the magnetic material of the susceptor wire is selected such that the Curie point of the magnetic material is equal to or greater than the first predetermined temperature and is below the melting temperature of the thermoplastic matrix;

the susceptor wire is responsive to the magnetic field generated by the conductor wire to uniformly heat the thermoplastic matrix to a heated temperature that is above the first predetermined temperature and that is below or equal to the Curie point; and the thermoplastic matrix includes:

a first thermoplastic material embedding the conductor wire and the susceptor wire therein, the first thermoplastic material being configured to change from a solid state to a pliable state when heated to the first predetermined temperature, and a second thermoplastic material surrounding the first thermoplastic material, the second thermoplastic material being configured to change from a solid state to a pliable state when heated to a second predetermined temperature that is lower than the first predetermined temperature of the first thermoplastic material.

10. The heating blanket of claim 9, further comprising reinforcing fibers disposed in the thermoplastic matrix and positioned on opposite sides of the conductor wire and the susceptor wire, thereby to reduce deformation of the conductor wire and the susceptor wire in the thermoplastic matrix.

11. The heating blanket of claim 9, wherein the heating blanket is preformed to an approximate shape of a contoured composite structure.

12. The heating blanket of claim 9, wherein the thermoplastic matrix is preformed to an approximate shape of at least a portion of the contoured surface of a contoured composite structure.

13. The heating blanket of claim 9, wherein the susceptor wire comprises at least a first alloy susceptor wire material having a first Curie point and a second alloy susceptor wire material having a second Curie point different than the first Curie point.

14. The heating blanket of claim 1, in which a first one of the conductor wire and the susceptor wire is wrapped around a remaining one of the conductor wire and the susceptor wire in a spiral configuration.

15. The heating blanket of claim 14, further comprising reinforcing fibers disposed in the thermoplastic matrix and positioned on opposite sides of the conductor wire and the susceptor wire, thereby to reduce deformation of the conductor wire and the susceptor wire in the thermoplastic matrix.

16. The heating blanket of claim 1, wherein the susceptor wire is wrapped around the conductor wire in a spiral configuration.

17. The heating blanket of claim 9, wherein the heating blanket is preformed to an approximate shape of a contoured composite structure.

18. A heating blanket, comprising:

a first thermoplastic material configured to change from a solid state to a pliable state when heated to a first predetermined temperature;

a second thermoplastic material surrounding the first thermoplastic material and configured to change from a solid state to a pliable state when heated to a second predetermined temperature, which is lower than the first predetermined temperature;

a conductor wire embedded in the first thermoplastic material and configured to receive an electrical current and generate a magnetic field in response to the electrical current; and a susceptor wire embedded in the first thermoplastic material and composed of a magnetic material having a Curie point, wherein the Curie point of the magnetic material is equal to or greater than the second predetermined temperature.

19. The heating blanket of claim 18, wherein the heating blanket is preformed to an approximate shape of a contoured composite structure.

20. The heating blanket of claim 18, wherein the susceptor wire comprises at least a first alloy susceptor wire material having a first Curie point and a second alloy susceptor wire material having a second Curie point different than the first Curie point.

* * * * *